US006665970B1

(12) United States Patent
Yun

(10) Patent No.: US 6,665,970 B1
(45) Date of Patent: Dec. 23, 2003

(54) PHOTOGRAPH QUICK-CHANGE DISPLAY APPARATUS

(76) Inventor: Chong S. Yun, 1742 Edgecliff Dr., Sandy, UT (US) 84092

( * ) Notice: Subject to any disclaimer, the term of this patent is extended or adjusted under 35 U.S.C. 154(b) by 224 days.

(21) Appl. No.: 09/648,157

(22) Filed: Aug. 25, 2000

(51) Int. Cl.[7] ..... G09F 7/02
(52) U.S. Cl. ..... 40/661; 618/109
(58) Field of Search ..... 40/661, 617, 618, 40/619, 620

(56) References Cited

U.S. PATENT DOCUMENTS

| | | | | | |
|---|---|---|---|---|---|
| 1,308,695 | A | * | 7/1919 | Bushkovski | 40/757 |
| 1,291,270 | A | * | 11/1919 | Beaven | 40/619 |
| 2,611,981 | A | * | 9/1952 | Whitebread | 40/546 |
| 4,034,496 | A | | 7/1977 | Cohen | |
| 4,044,483 | A | | 8/1977 | Williams | |
| 4,063,378 | A | | 12/1977 | Burke | |
| 4,138,305 | A | | 2/1979 | Williams | |
| 4,146,984 | A | | 4/1979 | Lindquist | |
| 4,171,584 | A | * | 10/1979 | Kaiser | 40/661 |
| 4,184,278 | A | | 1/1980 | Fournet | |
| 4,196,535 | A | | 4/1980 | Heimo | |
| 4,672,757 | A | * | 6/1987 | Field | 40/618 |
| 4,684,029 | A | | 8/1987 | Righini | |
| 4,783,921 | A | * | 11/1988 | George | 40/602 |
| 4,870,765 | A | | 10/1989 | McLeod | |
| 5,025,581 | A | | 6/1991 | Polzin | |
| 5,072,532 | A | | 12/1991 | Kelly | |
| 5,189,820 | A | | 3/1993 | Komamura | |
| 5,253,439 | A | | 10/1993 | Shanok et al. | |
| 5,277,949 | A | | 1/1994 | Green | |
| 5,305,537 | A | | 4/1994 | Pascarelli | |
| 5,323,552 | A | | 6/1994 | Fritz | |
| 5,375,352 | A | | 12/1994 | Morris | |
| 5,456,034 | A | | 10/1995 | Lewis et al. | |
| 5,544,436 | A | | 8/1996 | Lefkowitz | |
| 5,640,793 | A | | 6/1997 | Fischer | |
| 5,893,229 | A | | 4/1999 | Werner | |
| 6,055,757 | A | | 5/2000 | Carlsson | |
| 6,065,236 | A | * | 5/2000 | Schneider | 40/757 |
| 6,073,374 | A | * | 6/2000 | Tingmo | 40/546 |

* cited by examiner

*Primary Examiner*—Cassandra H. Davis
(74) *Attorney, Agent, or Firm*—J. David Nelson

(57) ABSTRACT

An apparatus for displaying collections of photographs, art works in sheet or card form, and other display items of various sizes and shapes is comprised of a display panel of stiff or rigid transparent sheet material and one or more retainers affixed to the rear surface of the display panel. The apparatus can be made with wall mount slots or attachments or can be made with a base stand for free-standing configurations.

8 Claims, 4 Drawing Sheets

LEGEND
1 Display apparatus
2 Display panel
3 Retainer
5 Display item
6 Photograph
7 Card art
8 General interest item
9 Support chain LEGEND
1 Display apparatus
2 Display panel
3 Retainer
4 Display panel rear surface
10 Full width retainer
11 Display panel width
12 Part width retainer
13 Retainer horizontal leg
14 Retainer vertical leg
15 Retainer spacing LEGEND
1 Display apparatus
2 Display panel
3 Retainer
5 Display item
6 Photograph
7 Card art
8 General interest item
9 Support chain

LEGEND

1 Display apparatus
2 Display panel
3 Retainer
4 Display panel rear surface
10 Full width retainer
11 Display panel width
12 Part width retainer
13 Retainer horizontal leg
14 Retainer vertical leg
15 Retainer spacing

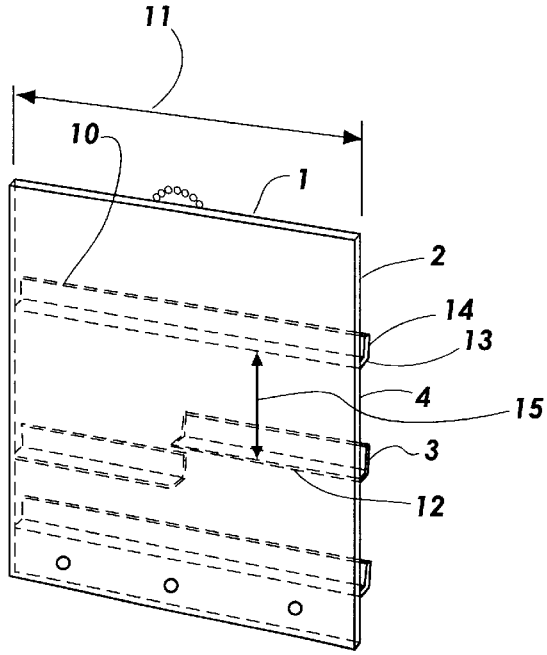

FIG. 2

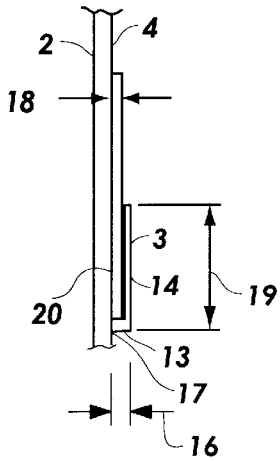

LEGEND

2 Display panel
3 Retainer
4 Display panel rear surface
13 Retainer horizontal leg
14 Retainer vertical leg
16 Retainer horizontal leg length
17 Retainer attachment
18 Display item thickness
19 Retainer vertical leg height
20 Retainer cavity

FIG. 3

LEGEND

1 Display apparatus
28 Base stand
29 Free standing configuration
30 Stand base plate
31 Vertical stand plate
32 Stand Base Plate top
33 Vertical stand plate spacing
34 Stand base plate width
35 Vertical stand plate height
36 Dowel
37 Stand Fastener Shaft way
38 Display panel fastener shaft way
39 Display apparatus base

PHOTOGRAPH QUICK-CHANGE DISPLAY APPARATUS

FIELD OF INVENTION

The present invention is in the field of devices for the display of photographs, art work in sheet and card form, and other display items in sheet and card form, and in particular in the field of display devices for displaying multiple photographs and other display items which provide for the easy and rapid exchange of the photographs and other display items displayed.

BACKGROUND OF THE INVENTION

Various versions of picture frames, which consist of a frame, backing and a transparent front panel have traditionally been used to display photographs, art work and other display items. The display item is affixed between the backing and the front panel and the front panel and the backing are secured to the frame. The inventions disclosed in U.S. Pat. No. 4,063,378 to Burke; U.S. Pat. No. 4,146,984 to Lindquist; U.S. Pat. No. 4,184,278 to Fournet; U.S. Pat. No. 4,870,765 to McLeod; U.S. Pat. No. 5,189,820 to Komamura; U.S. Pat. No. 5,072,532 to Kelly; U.S. Pat. No. 5,253,439 to Shanok; U.S. Pat. No. 5,277,949 to Green; U.S. Pat. No. 5,640,793 to Fischer; and U.S. Pat. No. 6,055,757 to Carlsson utilize a frame structure and provide some variations and improvements to the common picture frame. These devices incorporate various means of securing the front panel and the backing to the frame with the picture between the backing and the front panel. Each of these devices has obvious limitations in displaying collections of display items, resulting in difficulty in organizing and positioning a collection of display items and in readily exchanging display items.

The need for display devices that provide for an easier exchange of display items has been identified by the inventors of a number of prior art devices. U.S. Pat. No. 5,893,229 to Werner discloses a device for securing photographs to a display which includes a sheet-like outer frame by means of a plastic wrap adhered to the frame. The plastic wrap then may cling to photographs by means of a static charge to hold the photo in place. This device only works with display materials which can hold a sufficient static charge. It is not well adaptable to displaying a collection of display items.

U.S. Pat. No. 5,025,581 to Polzin discloses a device which incorporates a sheet-like frame with a transparent display area, the frame being attached to a wall or other surface with an adhesive. The frame has an opening which provides for the removal and replacement of a display item without removing the frame from the surface that it is adhered to. This device is not adaptable to a collection of display items. It is designed for a display item of a specific size.

U.S. Pat. Nos. 4,044,483 and 4,138,305 to Williams disclose a quick-change display device comprising two sheets of clear glass hinged together. The display item is affixed between the two plates of glass and may be readily removed and replaced by rotating apart the edges of the glass opposite the hinge. Several undesirable features or limitations of this device are readily apparent. The device has no built in mechanism for affixing the display item to the device. Rather it depends upon the sheets of glass being pressed against each other with the display item being impinged between them. This is particularly unsatisfactory for displaying collections of display items where maintaining displayed items in their respective display positions will be difficult. Further, removing and replacing one or more items of the collection will result in the remaining items being disturbed.

U.S. Pat. No. 6,065,236 to Schneider and U.S. Pat. No. 5,456,034 to Lewis disclose devices whereby a display item is enclosed by a transparent envelope. These devices are adapted to display items of specific sizes and they provide very limited access to the display item. These devices are not adaptable to collections of display items.

U.S. Pat. No. 4,196,535 to Heimo discloses a device for displaying translucent display items. This device includes use of a foil. A pane serves as a back support for the pictures. The pictures are arranged on the pane and kept in place by placing a transparent elastic foil material over the pane. The elastic foil is secured to the pane by use of clamps. This device does not provide for the ready exchange of display items, as the foil must be removed, the display items exchanged and the foil replaced.

The need for display devices that provide for the display of a collection of photographs, art work in sheet or card form, or other display items in sheet or card form, and provide for the quick and easy exchange of the display items, has been noted by the inventors of a number of prior devices. Various types of devices have been developed which utilize transparent pockets or similar features for the individual positioning and display of display items.

U.S. Pat. No. 4,034,496 to Cohen discloses a modular picture holder which incorporates a number of separated compartments with sidewalls of varying depths. The varying sidewall depths create a three dimensional effect. This device does not provide for the display and ready exchange of collections of display items of varying sizes and does not have a streamlined cross-section for wall mounting.

U.S. Pat. No. 4,684,029 to Righini discloses a display stand comprised of an array of rectangular frame sections. Photographs may be positioned and rotated in each frame section to provide for variation in the rotational position of the displayed items. This device also does not provide for the display and ready exchange of collections of display items of varying sizes and does not have a streamlined cross-section for wall mounting. This device also does not provide for the protection of the display items. It is intended for displaying photographs of a specific size.

U.S. Pat. No. 5,305,537 to Pascarelli discloses a device having a matrix of transparent pockets in a web with uniform rectangular openings. Each pocket has a slot in the top for the insertion of a display item. This device does not provide for the display and ready exchange of collections of display items of varying sizes and does not have a streamlined cross-section for wall mounting.

U.S. Pat. No. 5,323,552 to Fritz discloses a set of pockets which are secured together by snap fit buttons inserted through alined holes in the respective fringes of adjacent pockets. The pockets are open on the top and display items are inserted therein. This device is intended to display a collection of display items of a specific size with one display item being displayed in each pocket, the size of the display item matching the size of the pocket in which it is inserted. The pockets are not suited for the display of display items of varying sizes or for the display of more than one display item.

U.S. Pat. No. 5,375,352 to Morris discloses a display panel assembly which provides for the viewing of the front and the rear of flat display items without removing the display items form the device. A peripheral frame supports a rigid, transparent front panel and a flexible, transparent, pocketed rear sheet which is held in contact with the front panel by the peripheral frame. Pockets are formed on the back of the flexible rear sheet by strips of the same flexible material. The pockets are designed to display items of a specific, uniform size. Exchange of the display items is difficult unless the display items equal or exceed the specific minimum size.

U.S. Pat. No. 5,544,436 to Lefkowitz discloses a device for displaying a collection of display items of a specific standard size. This device is constructed of a plurality of vertical panels connected by hinge arrangements, the vertical panels being constructed of a front sheet and a rear sheet of transparent material. Flat display items are inserted in the side of each vertical panels, between the front sheet and the rear sheet. It is difficult to remove and replace a display item, particularly if the display item is inserted all the way between the front and rear sheets.

It is an objective of the present invention to provide a display apparatus for photographs, artwork and other display items in card or sheet form which will accommodate display items of varying sizes and shapes.

It is a further objective of the present invention to provide a display apparatus for photographs, artwork and other display items for which display items can be readily and selectively removed and replaced with other display items.

It is a further objective of the present invention to provide a display apparatus for photographs, artwork and other display items which has no obstruction interfering with the viewing of the entire surface of each of the display items.

It is a further objective of the present invention to provide a display apparatus for photographs, artwork and other display items which has an integrated structure with retainers affixed to a transparent, stiff display panel thereby eliminating the need for a frame or backing to the display apparatus.

It is a further objective of the present invention to provide a display apparatus for photographs, artwork and other display items which is economical.

It is a further objective of the present invention to provide a display apparatus for photographs, artwork and other display items which can be wall mounted or base stand mounted for a free-standing display configuration.

SUMMARY OF THE INVENTION

The present invention is an apparatus for displaying a collection of photographs, works of art printed on sheets or cards, and other display items printed on sheets or cards. The apparatus comprises a display panel and one or more retainers affixed to the back surface of the display panel. The display panel may also be constructed of translucent material for a desired artistic effect.

The display panel may be constructed by any type of stiff or rigid transparent material such as glass, plexiglass, acrylic or plastic. It can be clear or tinted and may have a plain edge or decorative edge with etching or other decorative treatment. Similarly, the interior portion of the display panel may be plain or decorated in the manner desired by the user.

The retainers typically have an L-shaped cross section with a short horizontal segment, the length of which is determined by the thickness of the photographs or other display items sought to be displayed. The height of the vertical portion of the retainer may be varied depending upon the type and size of the display items sought to be displayed. The height may also need to be varied depending upon whether the apparatus is to be wall-mounted or free-standing. Each retainer may run the full width of the display panel or may run in shorter segments for artistic considerations or display item size variation considerations. The retainer will typically be constructed of thin, stiff and somewhat pliable materials such as a strong plastic or nylon. A transparent material will ordinarily be desirable to minimize detraction from the display of the photographs or art material. For preferred embodiments it is important that the material selected for the retainers may be readily bonded with the display panel. Depending upon the materials used for the display panel and the retainers, the retainers may be heat welded, solvent welded, or attached with silicone sealants or a similar material to the display panel. Although a mechanical joint such as a tongue and groove could be used, it would likely be undesirable from an artistic stand point and would likely be more costly.

The apparatus of the present invention may be equipped with a means for attaching the apparatus to a wall or may be equipped with a base stand for free-standing display on a floor, mantle, table, cabinet or other similar locations. One or more wall mounting slots in the display panel will allow the display panel to be inserted upon anchor fasteners in a wall or the display panel may be equipped with a chain or other similar decorative devices to affix the display panel to a wall. Alternatively, a base stand in which the base of the display panel can be inserted can be used to support the apparatus of the present invention in a free-standing configuration. Other means for attaching the present invention to a wall or for supporting it in a free-standing configuration will be obvious to persons skilled in the art.

The present invention provides an apparatus for enhancing the organizing and displaying of photographs and other display items. This invention provides for the easy and fast placement, removal, replacement and exchange of photographs and other display items without the utilization of tools of any kind. The invention provides protection against scratch, impact and spillage. The invention provides for the replacement or reorganization of specific displayed items without disrupting the remainder of the displayed items. The invention provides for the display of regular and irregular shapes of display items, with great variations in size. Depending upon the size and arrangement of the retainers, a wide variation in the size of displayed items can be accommodated on a single display panel.

The present invention also provides for a wide variety in the nature of the presentation of the displayed items. The display panel can be plain and clear or it can be colored, bordered, etched or decorated in any manner desired. Regardless of the presentation, the present invention will be a very economical apparatus for the readily exchangeable display of collections of photographs and other display items. In its basic form, the present invention offers no obstruction to any photograph or other displayed item. The device may also be back lighted for visual enhancement or artistic effect.

BRIEF DESCRIPTION OF THE DRAWINGS

FIG. 2 is a front view perspective showing the display panel and retainers of the present invention.

FIG. 3 is a side view section detail showing the preferred embodiment of a retainer and its connection to the display panel.

DETAILED DESCRIPTION OF PREFERRED EMBODIMENTS

Figure 1:
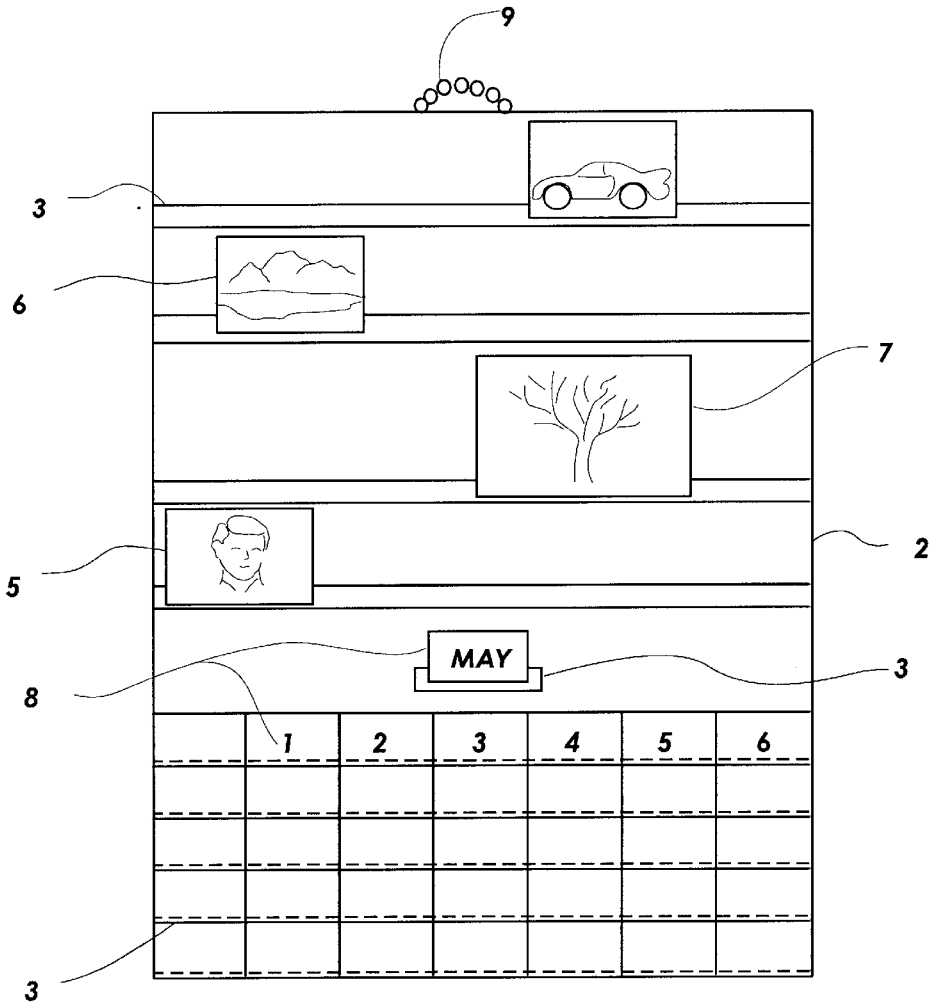
FIG. 1 is a front elevation view of a preferred embodiment of the present invention with a typical wall mount device.

Referring first to FIG. 1, a preferred embodiment of the display apparatus 1 of the present invention is illustrated. The display apparatus is comprised of a display panel 2 of transparent material with one or more retainers 3 affixed to the rear surface 4 of the display panel as shown in FIG. 2. Referring again to FIG. 1, a display item 5 such as a photograph 6, card art 7 or general interest item 8 such as calendar date, are held in position behind the display panel by the retainers. A typical support chain 9 for attaching the display apparatus to a wall is illustrated.

Referring again to FIG. 2, it will be noted that a full width continuous retainer 10 may extend the full width 11 of the display panel or part width retainers 12 may be provided to accommodate display items of widely varying sizes. Referring also to FIG. 3, for preferred embodiments, the retainers may be L-shaped with the short, horizontal leg 13 of a retainer being, of a length 16 selected based upon the thickness 18 of the display items sought to be displayed. Similarly, the height 19 of the vertical leg 14 of a retainer will be determined by the size and type of the display item sought to be displayed therein. The spacing 15 between the adjacent retainers will likewise be determined based upon the size of the display items sought to be displayed.

While the retainers are typically L-shaped with the short horizontal leg connected to the display panel as shown in FIGS. 2 and 3, the retainers can be formed in a number of different shapes so long as the vertical leg provides for supporting the display items against the rear surface of the display panel. Specifically, angular, u-shaped, curved, or other configurations may be used for the retainers. The L-shaped configuration provides the desired support for the display items without binding or damaging the display items.

The attachment 17 of the retainer to the display panel depends primarily on the types of materials used for the display panel and the retainers respectively. The display panel may be constructed by any type of transparent material such as glass, plexiglass, acrylic or plastic. It can be clear, tinted and may have a plain edge or decorative edge with etching or other decorative treatment. Similarly, the interior portion of the display panel may be plain or decorated in the manner desired by the user. Depending upon the types of materials used for the display panel and the retainer respectively, the retainer attachment may be a heat weld, a solvent weld, a glue joint, an epoxy joint, a silicon joint or other types of heat, chemical or adhesive connection such as is well known by persons skilled in the art. For preferred embodiments, the retainer will be of a stiff but somewhat pliable material, to allow for the easy insertion of the display item while providing for a tight fit about the display item after it is inserted in the retainer cavity 20.

Figure 4:
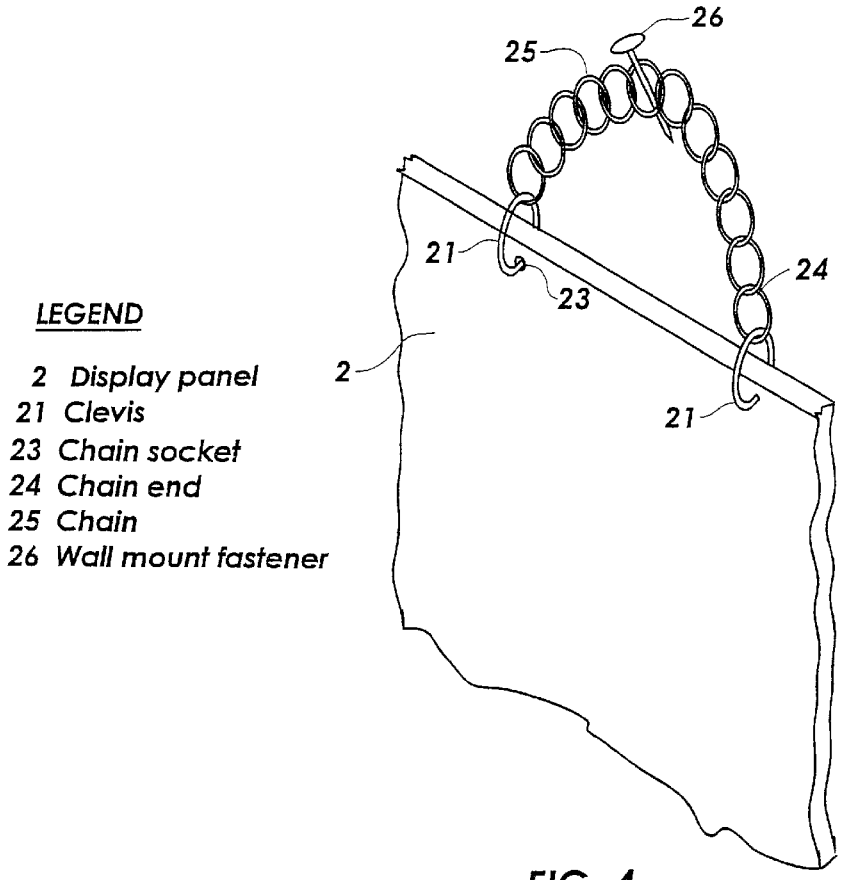
FIG. 4 is a front view perspective detail of a wall mount chain.

A typical chain wall mount is shown in FIG. 4. The pair of clevises 21, each of which has its ends 22 inserted in clevis sockets or a clevis shaft way 23 formed, drilled or punched in the display panel, may be used to attach the respective ends 24 of a chain 25 or other type of wire or cord which is used to affix the display apparatus to a wall mount fastener 26.

Figure 5:
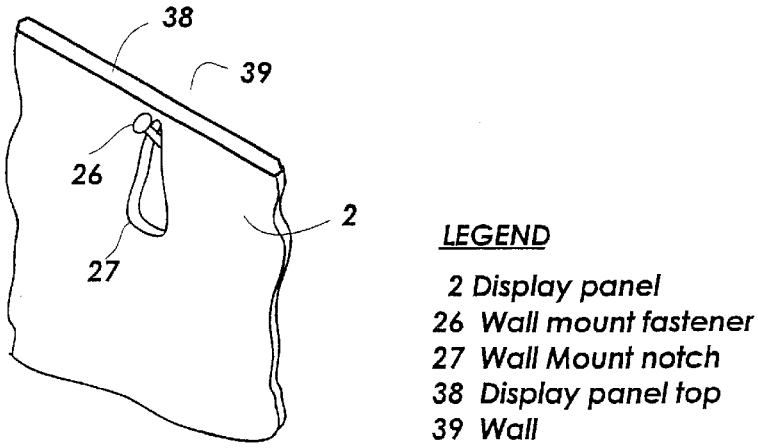
FIG. 5 is a front view perspective detail of a wall mount slot.

Referring now to FIG. 5, a wall mount notch 27 that may be molded, formed, cut, punched or constructed in another manner known by persons skilled in the art may be formed near the top 38 of a display panel 2 to provide for an insertion of the display panel over a wall mount fastener 26 for securing the display panel on a wall 39. One wall mount slot may be used or two wall mount slots may be used to provide additional security and stability, particularly if a heavier glass is used for the display panel.

Figure 6:
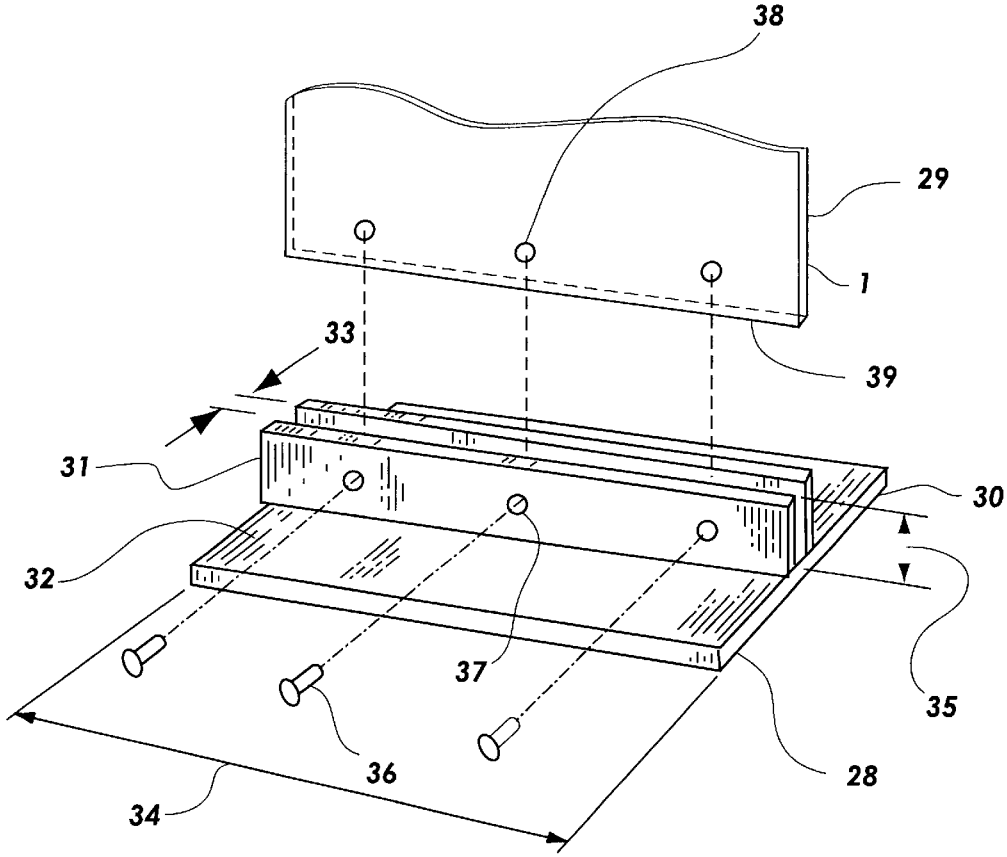
FIG. 6 is a front view perspective detail of a base stand for the present invention.

Referring now to FIG. 6, a base stand 28 to provide support for the display apparatus 1 in a free-standing configuration 29 is illustrated. A preferred embodiment of the base stand is comprised of a horizontal stand base plate 30 and a pair of vertical stand plates 31. The vertical stand plates are affixed to the top 32 of the stand base plate. The spacing 33 of the vertical stand plates is such to provide for a tight fit with the base 39 of the display apparatus. The width 34 of the stand base plate and the height 35 of the vertical stand plates will be dependent upon the size and weight of the display apparatus so as to provide for adequate stability. One or more dowels 36 or other type of fasteners may be used which are extended through stand fastener shaft ways 37 and through display panel fastener shaft ways 38 securing the display panel to the base stand.

Other embodiments of the invention and other variations and modifications of the embodiments described above will be obvious to a person skilled in the art. Therefore, the foregoing is intended to be merely illustrative of the invention and the invention is limited only by the following claims.

What is claimed is:

1. Apparatus for displaying a plurality of display items comprising:

a) a stiff, transparent display panel having a rear surface and one or more wall mount slots near the top edge of the display panel; and b) one or more retainers which are affixed to the rear surface of the display panel, each retainer having a vertical leg extending upward for holding one or more display items between the display panel and the vertical leg, each retainer having a vertical spacing from any adjacent retainer affixed above the retainer on the display panel which vertical spacing is greater than the height of the display items sought to be displayed in the retainer, each retainer alone having the capability of retaining and displaying one or more display items independently of the other retainers.

2. Apparatus for displaying a plurality of display items comprising:

a) a stiff, transparent display panel having a rear surface;

b) one or more retainers which are affixed to the rear surface of the display panel, each retainer having a vertical leg extending upward for holding one or more display items between the display panel and the vertical leg, each retainer having a vertical spacing from any adjacent retainer affixed above the retainer on the display panel which vertical spacing is greater than the height of the display items sought to be displayed in the retainer, each retainer alone having the capability of retaining and displaying one or more display items independently of the other retainers; and c) a wall mount chain which is attached to the display panel by a pair of clevises which are affixed to the display panel.

3. Apparatus for displaying a plurality of display items comprising:

a) a stiff, transparent display panel having a rear surface;

b) one or more retainers which are affixed to the rear surface of the display panel, each retainer having a vertical leg extending upward for holding one or more display items between the display panel and the vertical leg, each retainer having a vertical spacing from any adjacent retainer affixed above the retainer on the display panel which vertical spacing is greater than the height of the display items sought to be displayed in the retainer, each retainer alone having the capability of retaining and displaying one or more display items independently of the other retainers; and c) a base stand providing for the support of the display apparatus in a free-standing configuration.

4. Apparatus as recited in claim 3 wherein the base stand is comprised of a horizontal stand base plate and a pair of vertical plates affixed to the top of the stand base plate, the separation of the vertical plates corresponding to the thickness of the display panel and the display panel being affixed to the base stand by one or more fasteners.

5. Apparatus for displaying a plurality of display items comprising:

a) a display panel of transparent, stiff sheet material, the display panel having one or more wall mount slots near the top edge of the display panel; and b) one or more L-shaped retainers affixed to the rear surface of the display panel, the retainers each having a horizontal leg and a vertical leg, the horizontal leg having one end affixed to the rear surface of the display panel and an opposing end affixed to the vertical leg, the horizontal leg of each retainer respectively having a length corresponding to the thickness of the display items sought to be displayed by the retainer, the vertical leg extending upward from the horizontal leg, the vertical leg of each retainer having a height determined by the size and type of the display items sought to be displayed, each retainer having a vertical spacing from any adjacent retainer affixed above the retainer on the display panel which vertical spacing is greater than the height of the display items sought to be displayed in the retainer, each retainer alone having the capability of retaining and displaying one or more display items independently of the other retainers.

6. Apparatus for displaying a plurality of display items comprising:

a) a display panel of transparent, stiff sheet material;

b) one or more L-shaped retainers affixed to the rear surface of the display panel, the retainers each having a horizontal leg and a vertical leg, the horizontal leg having one end affixed to the rear surface of the display panel and an opposing end affixed to the vertical leg, the horizontal leg of each retainer respectively having a length corresponding to the thickness of the display items sought to be displayed by the retainer, the vertical leg extending upward from the horizontal leg, the vertical leg of each retainer having a height determined by the size and type of the display items sought to be displayed, each retainer having a vertical spacing from any adjacent retainer affixed above the retainer on the display panel which vertical spacing is greater than the height of the display items sought to be displayed in the retainer, each retainer alone having the capability of retaining and displaying one or more display items independently of the other retainers; and c) a wall mount chain which is attached to the display panel by a pair of clevises which are affixed to the display panel.

7. Apparatus for displaying a plurality of display items comprising:

a) a display panel of transparent, stiff sheet material;

b) one or more L-shaped retainer affixed to the rear surface of the display panel, the retainers each having a horizontal leg and a vertical leg, the horizontal leg having one end affixed to the rear surface of the display panel and an opposing end affixed to the vertical leg, the horizontal leg of each retainer respectively having a length corresponding to the thickness of the display items sought to be displayed by the retainer, the vertical leg extending upward from the horizontal leg, the vertical leg of each retainer having a height determined by the size and type of the display items sought to be displayed, each retainer having a vertical spacing from any adjacent retainer affixed above the retainer on the display panel which vertical spacing is greater than the height of the display items sought to be displayed in the retainer, each retainer alone having the capability of retaining and displaying one or more display items independently of the other retainers; and c) a base stand providing for the support of the display apparatus in a free-standing configuration.

8. Apparatus as recited in claim 7 wherein the base stand is comprised of a horizontal stand base plate and a pair of vertical plates affixed to the top of the stand base plate, the separation of the vertical plates corresponding to the thickness of the display panel and the display panel being affixed to the base stand by one or more fasteners.

* * * * *